United States Patent [19]

Ward

[11] 4,060,246

[45] Nov. 29, 1977

[54] HORSE-RACE-SIMULATING PARLOR OR CASINO GAME OF PURE CHANCE

[76] Inventor: Leslie J. Ward, 2450 Blackwood Drive, Vineland, N.J. 08360

[21] Appl. No.: 790,710

[22] Filed: Apr. 25, 1977

[51] Int. Cl.[2] ..... A63F 3/00

[52] U.S. Cl. ..... 273/135 AA; 273/134 DB; 273/134 CH

[58] Field of Search ..... 273/86 A, 134 CH, 134 CA, 273/134 DB, 134 CG, 134 AG, 135 R, 135 AC, 135 AA; 283/49

[56] References Cited

U.S. PATENT DOCUMENTS

| | | | |
|---|---|---|---|
| 1,520,081 | 12/1924 | Purnell | 273/134 DB |
| 1,552,617 | 9/1925 | Kisor | 273/93 R |
| 1,660,505 | 2/1928 | Hacker | 273/134 CH |
| 1,797,742 | 3/1931 | Ward | 273/134 AG |
| 2,823,919 | 2/1958 | Scruggs | 273/134 AG |
| 3,560,127 | 2/1971 | Imperato | 273/134 CH |
| 3,690,666 | 9/1972 | Seitz | 273/134 CH |
| 3,834,709 | 9/1974 | Lamb | 273/134 CH |

*Primary Examiner*—Richard C. Pinkham
*Assistant Examiner*—Harry G. Strappello
*Attorney, Agent, or Firm*—Leonard L. Kalish

[57] ABSTRACT

A horse-race-simulating parlor, casino or the like game of pure chance, comprising a combination of a pair of dice which can be rolled to eleven numbers, from 2 to 12, and a play-board having thereon eleven play-numbers, from 2 through 12, representing eleven horses, and a finish-number which is the lowest common multiple of the numbers 1, 2, 3, 4, 5 & 6 representing ways in which said eleven horse-numbers can be rolled by the dice or is a multiple of such lowest-common-multiple, and having a chance-equalizing number for each play-number or horse-number, which chance-equalizing number is said lowest-common-multiple divided by the number of ways the play-number can be rolled by the dice.

21 Claims, 9 Drawing Figures

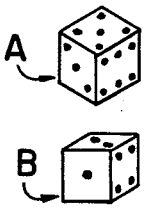

RACE No. 5 (13)
FURLONG: 3 (14)
FINISH: 180 (15)

PAY-OFF (18): WIN $ (16); PLACE $ $ (17); SHOW $ $ $

| No. (19) | HORSE (20) | LENGTH OF GALLOP (21) | GAL'PS TO FINISH (22) | GAL'PS WON (23) | 24 WIN | 25 PLC. | 26 SHO. |
|---|---|---|---|---|---|---|---|
| 2 | SNAKE EYES | 60 | 3 | 1 | | | |
| 3 | ARABIAN KNIGHT | 30 | 6 | 4 | | | |
| 4 | LITTLE JOE | 20 | 9 | 9 | X | | |
| 5 | PHOEBE | 15 | 12 | 2 | | | |
| 6 | PINTO | 12 | 15 | 7 | | | |
| 7 | THE REBEL | 10 | 18 | 18 | | | X |
| 8 | DECATUR | 12 | 15 | 2 | | | |
| 9 | PALOMINO | 15 | 12 | 3 | | | |
| 10 | RED MUSTANG | 20 | 9 | 9 | | X | |
| 11 | BOW LEGGS | 30 | 6 | | | | |
| 12 | BOX CARS | 60 | 3 | 1 | | | |

P-3

FIG. 1

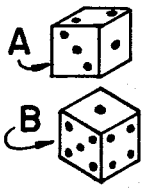

RACE No. 3 (13)
FURLONG: 7 (14)
FINISH: 420 (15)

PAY-OFF (18): WIN $ (16); PLACE $ $ (17); SHOW $ $ $

| No. (19) | HORSE (20) | LENGTH OF GALLOP (21) | GAL'PS TO FINISH (22) | GAL'PS WON (23) | 24 WIN | 25 PLC. | 26 SHO. |
|---|---|---|---|---|---|---|---|
| 2 | NICE BIT | 60 | 7 | 2 | | | |
| 3 | LAST CITY | 30 | 14 | 14 | | | X |
| 4 | BREEZY | 20 | 21 | 3 | | | |
| 5 | MISTY MODEL | 15 | 28 | | | | |
| 6 | SHARP KID | 12 | 35 | 15 | | | |
| 7 | WAR FIGHTER | 10 | 42 | | | | |
| 8 | PIA'S DOLL | 12 | 35 | 5 | | | |
| 9 | BLUE PANTHER | 15 | 28 | 28 | | X | |
| 10 | BEE ABE | 20 | 21 | | | | |
| 11 | QUEEN BOY | 30 | 14 | | | | |
| 12 | HALF SHOE | 60 | 7 | 7 | X | | |

P-7

FIG. 2

RACE No. 5 (13)
FURLONG: 2 (14)
FINISH: 120 (15)

A B

PAY-OFF

| WIN | PLACE | SHOW |
|---|---|---|
| $ (16) | $ (17) | $ (18) |
| | $ | $ |
| | | $ |

(27)

| No. (19) | HORSE (20) | GALLOP-LENGTH & GALLOPS TO FINISH | WIN 24 | PLACE 25 | SHOW 26 |
|---|---|---|---|---|---|
| 2 | SNAKE EYES | ~~60~~ 60 | | | |
| 3 | ARABIAN KNIGHT | ~~30 30 30 30~~ | | | X |
| 4 | LITTLE JOE | ~~20 20~~ 20 20 20 20 | | | |
| 5 | PHOEBE | 15 15 15 15 15 15 15 15 | | | |
| 6 | PINTO | ~~12 12 12 12 12 12 12 12 12 12~~ | | X | |
| 7 | THE REBEL | ~~10 10 10 10 10~~ 10 10 10 10 10 10 10 | | | |
| 8 | DECATUR | ~~12 12~~ 12 12 12 12 12 12 12 12 | | | |
| 9 | PALOMINO | ~~15 15 15 15~~ 15 15 15 15 | | | |
| 10 | RED MUSTANG | ~~20 20 20 20 20 20~~ | ✓ | | |
| 11 | BOW LEGGS | ~~30 30~~ 30 30 | | | |
| 12 | BOX CARS | 60 60 | | | |

P-2

FIG. 3

RACE No. 5 (13)
FURLONG: 2 (14)
FINISH: 120 (15)

A B

PAY-OFF

| WIN | PLACE | SHOW |
|---|---|---|
| $ (16) | $ (17) | $ (18) |
| | $ | $ |
| | | $ |

(27)

| No. (19) | HORSE (20) | GALLOP-LENGTH & GALLOPS TO FINISH | FINISH—ORDER (28) |
|---|---|---|---|
| 2 | SNAKE EYES | ~~60 60~~ | third |
| 3 | ARABIAN KNIGHT | ~~30 30~~ 30 30 | |
| 4 | LITTLE JOE | ~~20~~ 20 20 20 20 20 | |
| 5 | PHOEBE | ~~15 15 15 15~~ 15 15 15 15 | |
| 6 | PINTO | ~~12 12 12 12 12 12 12 12 12 12~~ | first |
| 7 | THE REBEL | ~~10 10 10~~ 10 10 10 10 10 10 10 10 10 | |
| 8 | DECATUR | ~~12 12 12 12 12~~ 12 12 12 12 12 | |
| 9 | PALOMINO | ~~15 15~~ 15 15 15 15 15 15 | |
| 10 | RED MUSTANG | 20 20 20 20 20 20 | |
| 11 | BOW LEGGS | ~~30 30 30 30~~ | 2nd |
| 12 | BOX CARS | 60 60 | |

P-2

FIG. 4

| No. | HORSE | LENGTH OF GALLOP | GAL'PS TO FINISH | GAL'PS WON | WIN | PLC. | SHO. |
|---|---|---|---|---|---|---|---|
| 2 | MARY. D. B. | 60 | 1 | | ◎ | ◎ | ◎ |
| 3 | ROMANTIC | 30 | 2 | | ◎ | ◎ | ◎ |
| 4 | CLEVER MISS | 20 | 3 | 1 | ◎ | ◎ | ◎ |
| 5 | INTREPID WAY | 15 | 4 | 4 | ◎ | ☼ | ◎ |
| 6 | A DAY LATE | 12 | 5 | 3 | ◎ | ◎ | ◎ |
| 7 | WIDE OPEN | 10 | 6 | 2 | ◎ | ◎ | ◎ |
| 8 | LORD JOHN | 12 | 5 | 3 | ◎ | ◎ | ◎ |
| 9 | LILA | 15 | 4 | 3 | ◎ | ◎ | ◎ |
| 10 | SCOTCH PIN | 20 | 3 | 1 | ◎ | ◎ | ◎ |
| 11 | FAVORITE FOOLER | 30 | 2 | 2 | ☼ | ◎ | ◎ |
| 12 | J.J. VICTORY | 60 | 1 | 1 | ◎ | ◎ | ☼ |

HORSE-RACE-SIMULATING PARLOR OR CASINO GAME OF PURE CHANCE

BRIEF SUMMARY OF THE INVENTION

The object of the invention is a horse-race-simulating game-of-chance, which can be played by any number of persons which can be suitably accommodated in a parlour or assembly hall, and each of whom can play or bet on any horse or on several horses on the play-board, and in which any number of persons can play or bet on the same horse or several horses, and wherein the odds or the chances of a particular horse coming in "first" (or to "win") winning or coming in "place" or coming in "show" is the same as for every other horse, and wherein the outcome is entirely a matter of chance and does not involve and can not be influenced by any skill on the part of the person playing the game. My horse-race-game offers quick action and suspense for any number of persons, and can either be played for only the scores and without any money or other thing of value accruing to any persons on the basis of his score or it can be played for money or other things of value.

Each roll of the dice advances one of the horses, namely, the horse whose number has been rolled by the dice, and each horse-advancement is herein called a "gallop". The respective gallop-lengths of the horses are as stated hereinabove.

The first horse to advance to the "finish" of 60 in a "one-furlong race" or to the "finish" of 120 in a "two-furlong race" or to the "finish" of 180 in a "three-furlong race" (and so on, a multiple of 60 corresponding in any other multi-furlong race) is the winner. The second horse to advance to such "finish" is the "place" horse and the third horse to advance to such "finish" is the "show" horse.

I may also include in the aforementioned play-board illuminated or mechanical indicators in juxtaposition to the respective horses, to be activated when a horse has reached "finish", and also to be activated to show the number of times each horse has been advanced or has "galloped", as the race progresses to its end, namely, 1 advancement or "gallop" for horses 2 & 12, and up to 2 advancements or "gallops" for horses 3 & 11, and up to 3 advancements or "gallops" for horses 4 & 10, and up to 4 advancements or "gallops" for horses 5 & 9, and up to 5 advancements or "gallops" for horses 6 & 8, up to 6 advancements or "gallops" for horse 7 in a "one-furlong race", and the furlong-multiple of the "finish" number and of such "gallops-needed" numbers for any multi-furlong race.

BRIEF DESCRIPTION OF THE DRAWINGS

FIG. 1 illustrates an embodiment of my invention;- with a play-panel for a 3 furlong race.

FIG. 2 illustrates the same embodiment of my invention; with a play-panel for a 7 furlong race.

FIG. 3 illustrates another embodiment of my invention; with a play-panel for a 2 furlong race.

FIG. 4 illustrates a modified embodiment of my invention shown in FIG. 3.

DETAILED DESCRIPTION OF THE INVENTION

Figure 5:
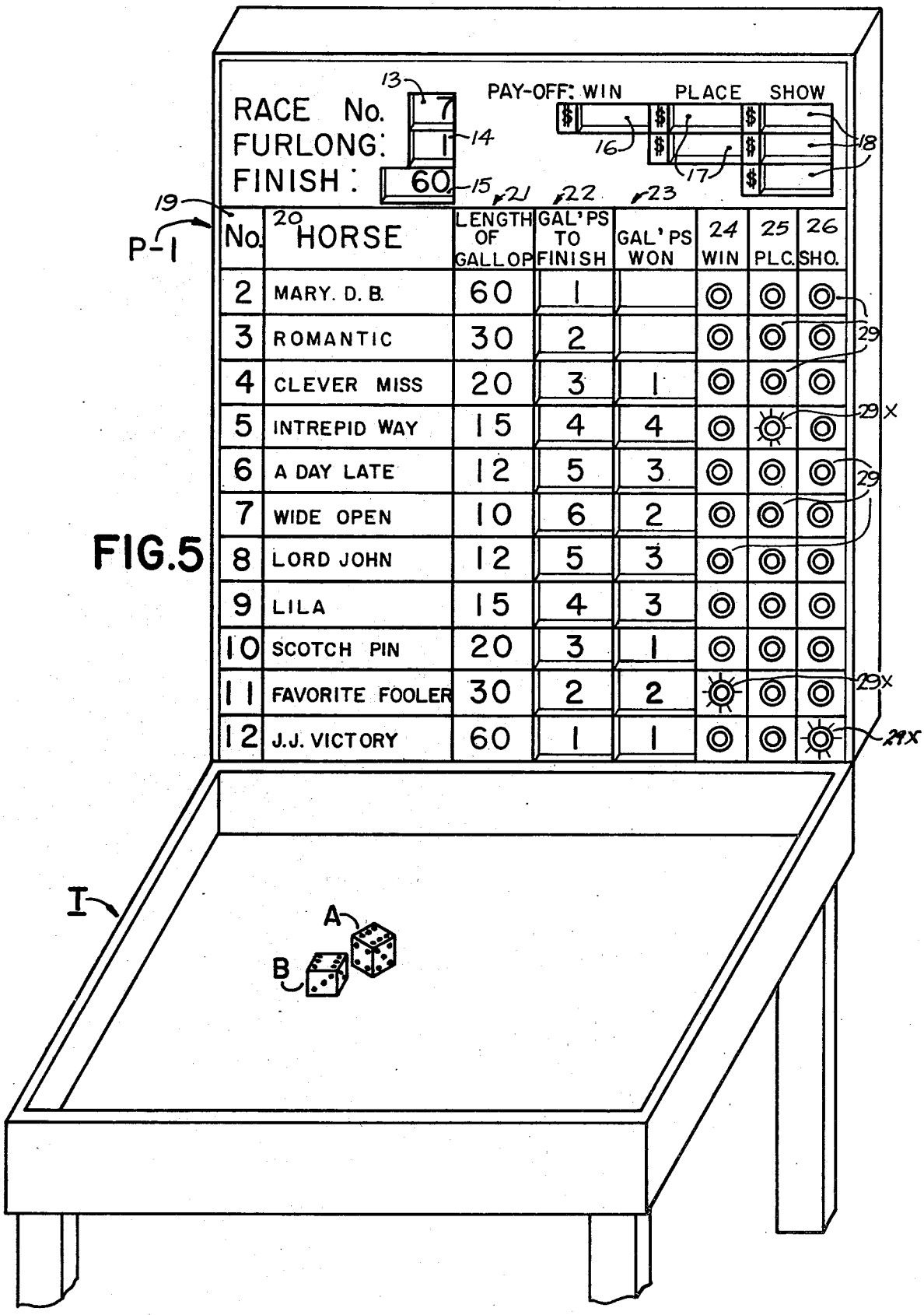
FIG. 5 illustrates another embodiment of my invention, with a play-panel for a one-furlong race and also showing a dice table in front of the play-panel.

The horse-race game of my invention involves eleven horses, which are numbered 2, 3, 4, 5, 6, 7, 8, 9, 10, 11 & 12, respectively. Each horse is advanced by a predetermined amount or "gallop-length" towards a predetermined finish-number when its horse-number is thrown or rolled by the pair of dice.

As indicated below, the finish-number is 60 for a one-furlong race and is the furlong-number multiple of 60 for any multi-furlong race. Thus, for example, for a 2 furlong race the finish-number is 120, for a 3 furlong race it is 180, for a 4 furlong race it is 240, for a 5 furlong race it is 300, for a 6 furlong race it is 360, for a 7 furlong race it is 420, and so on.

Each horse is assigned a chance-equalizing gallop-length-number such that in the long run the chance or probability of every horse is exactly equal to that of every other horse 1. of finishing first (or to "win")
2. of finishing second (or to "place")
3. of finishing third (or to "show")

The following Chart X shows the 36 ways a pair of conventional dice can be thrown to form the eleven horse-numbers 2, 3, 4, 5, 6, 7, 8, 9, 10, 11 & 12, and shows that each of horse-numbers 2 & 12 can be rolled only 1 way each of horse-numbers 3 & 11 can be rolled only 2 ways each of horse-numbers 4 & 10 can be rolled only 3 ways each of horse-numbers 5 & 9 can be rolled only 4 ways each of horse-numbers 6 & 8 can be rolled only 5 ways and horse-number 7 can be rolled only 6 ways

CHART X

| (A) Horse Number | (B) the 36 dice combinations which will make the eleven horse-numbers | (C) nubmer of ways each horse-number can be thrown |
|---|---|---|
| 2 | 1/1 | 1 |
| 3 | 1/2 2/2 | 2 |
| 4 | 1/3 3/1 2/2 | 3 |
| 5 | 1/4 4/1 2/3 3/2 | 4 |
| 6 | 1/5 5/1 2/4 4/2 3/3 | 5 |
| 7 | 1/6 6/1 2/5 5/2 3/4 4/3 | 6 |
| 8 | 2/6 6/2 3/5 5/3 4/4 | 5 |
| 9 | 3/6 6/3 4/5 5/4 | 4 |
| 10 | 4/6 6/4 5/5 | 3 |
| 11 | 5/6 6/5 | 2 |
| 12 | 6/6 | 1 |

The lowest common multiple of the numbers 1, 2, 3, 4, 5 & 6 (in Column C of Chart X) is 60, and 60 is made the "finish" number of a one-furlong race, and the finish-number of any multi-furlong race is 60 multiplied by the furlong number, as mentioned above.

The chance-equalizing gallop-length-number assigned to each horse is the aforementioned lowest common multiple number 60 divided by the number in Column C in Chart X representing the number of ways in which its horse-number can be rolled. Thus, the chance-equalizing gallop-length-number is 60 is assigned to each of horses 2 and 12, and 30 is assigned to horses 3 and 11, and 20 is assigned to horses 4 and 10, and 15 is assigned to horses 5 and 9, and 12 is assigned to horses 6 and 8, and 10 is assigned to horse 7. These chance-equalizing gallop-lengths remain constant regardless of the number of furlongs in a particular race. The following Chart Y shows the chance-equalizing gallop-length of each horse and the number of times the dice must be thrown to its horse-number in order for it to achieve the "finish" of a one-furlong race and the "finish" of any multi-furlong race.

numbers and the gallops-won numbers may be changeably displayed on the panel by changeable mechanical or light-emitting electric or electronic means (as, for example light-emitting diodes, liquid-crystal diodes and the like), and the "Win", "Place" and "Show" indications may likewise be displayed by such changeable mechanical, electrical or electronic means.

For example, the play board or panel P-3, illustrated in FIG. 1, is for a 3 furlong race, with a finish-number of 180 and on which the gallops-needed-to-finish number is 3 for horses 2 & 12, is 6 for horses 3 & 11, is 9 for horses 4 & 10, is 12 for horses 5 & 9, is 15 for horses 6 & 8, and is 18 for horse 7.

For further example, the play board or panel P-7, illustrated in FIG. 2, is for a 7 furlong race, with a finish number of 420, and on which the gallops-needed-to-finish is 7 for horses 2 & 12, is 14 for horses 3 & 11, is 21 for horses 4 & 10, is 28 for horses 5 & 9, is 35 for horses 6 & 8, and is 42 for horse 7.

CHART Y

| | | | number of times horse-number must be thrown to reach "finish" | | | | | | | | | | |
|---|---|---|---|---|---|---|---|---|---|---|---|---|---|
| horse No. | gallop length | Furlong: Finish: | 1 60 | 2 120 | 3 180 | 4 240 | 5 300 | 6 360 | 7 420 | 8 480 | 9 540 | 10 600 | 11 660 |
| 2 | 60 | | 1 | 2 | 3 | 4 | 5 | 6 | 7 | 8 | 9 | 10 | 11 |
| 3 | 30 | | 2 | 4 | 6 | 8 | 10 | 12 | 14 | 16 | 18 | 20 | 22 |
| 4 | 20 | | 3 | 6 | 9 | 12 | 15 | 18 | 21 | 24 | 27 | 30 | 33 |
| 5 | 15 | | 4 | 8 | 12 | 16 | 20 | 24 | 28 | 32 | 36 | 40 | 44 |
| 6 | 12 | | 5 | 10 | 15 | 20 | 25 | 30 | 35 | 40 | 45 | 50 | 55 |
| 7 | 10 | | 6 | 12 | 18 | 24 | 30 | 36 | 42 | 48 | 54 | 60 | 66 |
| 8 | 12 | | 5 | 10 | 15 | 20 | 25 | 30 | 35 | 40 | 45 | 50 | 55 |
| 9 | 15 | | 4 | 8 | 12 | 16 | 20 | 24 | 28 | 32 | 36 | 40 | 44 |
| 10 | 20 | | 3 | 6 | 9 | 12 | 15 | 18 | 21 | 24 | 27 | 30 | 33 |
| 11 | 30 | | 2 | 4 | 6 | 8 | 10 | 12 | 14 | 16 | 18 | 20 | 22 |
| 12 | 60 | | 1 | 2 | 3 | 4 | 5 | 6 | 7 | 8 | 9 | 10 | 11 |

Only eleven numbers (namely, numbers 2, 3, 4, 5, 6, 7, 8, 9, 10, 11 & 12) can be thrown or rolled by a pair of dice, and every roll of the dice advances a horse (and only one horse). Each of the eleven horses (numbered 2 through 12) is assigned one-eleventh of the 660 feet constituting a furlong, namely, each horse is assigned 60 feet in a one-furlong race. Likewise, each horse is assigned one-eleventh of the furlong-number-multiple of 60 feet in a multi-furlong race.

The horse that gallops 60 feet first in a one-furlong race or gallops the furlong-number-multiple of 60 feet in a multi-furlong race will be the winner, and the horse that gallops such number of feet second will be the place horse, and the horse that gallops such number of feet third will be the show horse.

A separate play-panel may be provided for each race of a different furlong or the same play-board may be used for races of different furlongs. In the accompanying drawings each of the playpanels is designated generally by the letter P, followed by the furlong-number as a suffix thereto. Thus, by way of example, the 3 furlong play-panel in FIG. 1 is designated as P-3, the 7 furlong play-panel in FIG. 1 is designated as P-7, the 2 furlong play-panels in FIGS. 3 & 4 are designated as P-2, and the 1 furlong play-panel in FIG. 5 is designated as P-1.

On such play-panels the finish-number and the gallops-needed-to-finish numbers may be permanent, or may be changeable by mechanical, electrical or electronic means, and the gallops-won numbers may be written in the gallops-won column with pen or pencil or any suitable marker (described hereinafter), and the "win" horse and the "place" horse and the "show" horse may be likewise marked in the columnar spaces provided therefor on the panel. However, the furlong-number and the finish-number and the gallops-needed Any race of any furlong-number may be the 1st, 2nd, 3rd, 4th, 5th, 6th, 7th, 8th, 9th, 10th or 11th race.

The more furlongs in a race and hence larger the "finish" number, the longer it will take to play out or complete the race.

As the race progresses, the spaces in the gallops-won column 23 may be filled in by one player or by a croupier on a larger master play-panel indicated in FIG. 5 or by each player on his own smaller play-panel with erasable penciled numbers or with a felt-tipped marker pen or other marker which makes readily erasable marks. When a horse has won the number of gallops indicated in the gallops-needed-to-finish column (or "Gal'ps to Finish" column) 22 then an X or any other suitable mark is similarly placed in the "win" column 24, in the "place" column 25 or in the "show" column 26, according to whether the particular horse was the first, second or third horse to complete the number of gallops needed by it to finish.

The play-panels exemplified in FIGS. 1 to 4 are imprinted as indicated in the drawings or variations thereof. The markings on such play-panels indicative of the gallops won as the race progresses and identifying the horse which came in first or in the "win" position and in "place" or "show", may be made by each player on his own disposable or permanent play-panel or may be made by a croupier on a larger play-panel visible to all players.

The large display panel P-1 shown in FIG. 5 may be mounted on the wall or on an easel or on the dice-table T, so as to be visible and readable by all players, and on which large play-panel a croupier places such markings on the panel or activates the electronic, mechanical, electrical or electro-mechanical indicators in FIG. 5, for the information of all players.

The play boards or panels exemplified in accompanying drawings may be formed by imprinting, in the manner indicated in said Figures, inexpensive sheet material pieces, such as suitable paper, to be marked up with pencil or pen in the gallops-to-finish column, the gallops-won column, and in the Win, Place and Show columns and in the Pay-Off boxes and also in the Race No., the Furlong and finish-number boxes. Such paper or other inexpensive play-boards may be disposed of at the end of each race. Such play-panels may be made for permanence and re-use by similarly imprinting a more durable sheet material such as white or light-tinted matte-surfaced cardboard, plastic-sheet of suitable hardness of Masonite or the like having a white or a light-tinted matte surface of suitable hardness or a porcelain enameled aluminum or non-ferrous sheet-metal or porcelain enameled sheet-steel having a white or a light-tinted hard matte surface on which readily erasable markings may be made with a felt-tipped marker-pen such as the "Rite-On Wipe-Off" marker pens referred hereinafter.

The horse-numbers 2 to 12 are preferably permanently printed or otherwise permanently applied to the play-panel in the left-most column 19 thereof shown in FIGS. 1, 2, 3, 4 & 5 and the horse-names and the gallop-length numbers, and the gallops-needed-to-finish numbers may likewise be permanently printed or otherwise permanently applied in the horse-name column 20, the gallop-length column 21, and the gallops-to-finish column 22; respectively.

Suitable check marks in the "win", "place" and "show" columns 24, 25 & 26 may be filled in by each player on his own individual panel P or by the croupier on a large panel visible to all players, as for example in FIG. 5. The panels P may be provided with a hard surface which will take an erasable marker-liquid, as, for instance, a matte surfaced porcelain enameled metal-sheet, such as a thin sheet of steel or a sheet of aluminum coated with a matte-surfaced porcelain enamel, or other hard-surfaced metallic or non-metallic panel on which readily erasable markings may be made with a felt-tipped marker-pen having a marking liquid therein consisting of highly volatile liquid in which very fine particles of a pigment are suspended, so that the rapid evaporation of the liquid will leave the marking "dry" almost instantaneously, and which markings can thereafter be erased by merely sweeping over them with the hand or with a tissue paper or other soft material. Such porcelain enameled sheet-steel and sheet-aluminum and the aforementioned felt-tipped "Rite-On Wipe-Off" marker-pens for use therewith are marketed by the Alliance Wall Corporation, of Wyncote, Pennsylvania.

Such porcelain-enameled sheet-metal panels P and other similar panels coated with a non-vitreous hard surface which are likewise capable of being effectively marked with such felt-tipped markers, are commonly referred to as a "white board" (in contradistinction to a black board) because they are white or some color in a very light or faint tint approaching white, with the markers used therewith being either black or other color providing contrast with such "white board".

The "gallops won" numbers may be hand-written in or mechanically, electrically or electronically displayed in the spaces of the "gallops won" column as the race progresses with each throw of the dice. Instead of placing a suitable mark in the "win" column, the "place" column and the "show" column, such markings may be provided by any suitable mechanical or electrical or electronically displayed markings, such as, for instance, a light which is activated when a horse comes in first, second and third.

If the play-panel P is formed of porcelain-enameled steel-sheet, the markings in the "gallops won" column may be effected by placing in said column, in juxtaposition to the horse-number thrown by the dice, a small magnetic piece bearing the number which represents the cumulative gallops won by that horse the last time its number was thrown by the dice, and the markings in the "win", "place" and "show" columns may be similarly effected by placing a small magnetic piece in the "win", "place" and "show" columns in juxtaposition to the horse which has come in first, second and third, respectively, or magnetic pieces bearing the words "Win" (or 1st), "Place" (or 2nd) and "Show" (or 3rd) may be placed in a single "FINISH ORDER" column indicated in FIG. 4, in juxtaposition to the horses which came in 1st, 2nd and 3rd.

FIG. 5 illustrates a dice-table T and, next to it, in a generally upright position, a panel P-1 in which the spaces in the gallops-needed-to-finish column 22 and the spaces in the gallops-won column 23 are either windows or openings through which the appropriate numbers on a wheel or disc or endless belt may be displayed, or in which like numbers otherwise produced electrically or electronically may be displayed and in which the appropriate lights 29 are activated in the "win", "place" and "show" columns (24, 25 & 26) when a horse has "won" or made "place" or "show". Likewise, the race-number and the furlong-number and the finish-number may be displayed through windows or openings 13, 14 & 15 by mechanical, electrical or electronic display means. Where the horse-race is played for money, then amounts payable on the "win" horse and the "place" horse and on the "show" horse can likewise be displayed through the windows or openings 16, 17 & 18 (FIG. 5).

The dice-table T shown in FIG. 5 can also be used (without the panel P-1) when the game is played with a small individual panel (shown in FIGS. 1, 2, 3, & 4) or when each player has one of such small individual panels for his use. In either case, the dice A & B may be thrown on the table T, and each participant may mark up his individual play-panel (FIGS. 1, 2, 3, & 4) as the person throwing the dice calls out the number to which the dice had been thrown.

In the embodiment of my invention exemplified in FIGS. 1, 2 & 5, a space or box 13 is provided for the race-number and a space or box 14 is provided for the furlong-number and a space or box 15 is provided for the finish-number, and a space or box 16 is provided for the amount to be payed out for "win", and spaces or boxes 17 are provided for the amounts to be payed out for "place" and spaces or boxes 18 are provided for amounts to be payed out for "show".

The horse-numbers shown in the leftmost column 19 of the play-panel, and the horse-names are in column 20, and the gallop-length numbers are in column 21, and the gallops-needed-to-finish numbers are in a column 22, and the gallops-won numbers are placed in column 23, and the "win", "place" and "show" markings are placed in columns 24, 25 & 26, respectively, in the embodiments shown in FIGS. 1, 2, 3 & 5.

In the embodiment illustrated in FIGS. 3 & 4 the gallop-length numbers and the gallops-needed-to-finish numbers are placed in a composite column 27, in which the gallop-length is repeated in each line as many times as the horse-number must be rolled in order to finish, and the progress of the race, namely, the number of gallops won by the horses during the course of the race is indicated by crossing out one of the gallop-length-numbers of the horse whose number has been rolled, as indicated in FIGS. 3 & 4. Instead of having the "win" column 24 and the "place" column 25 and the "show" column 26 (as in FIGS. 1, 2, 3, & 5) I may provide a single column 28, shown in FIG. 4, in which the first, second and third horse to achieve the finish-number is noted by the words "first", "second" and "third" or by the numbers "1", "2" and "3".

The horse-numbers in column 19 and the gallop-length-numbers in columns 21, in FIGS. 1 & 2, and the gallop-length numbers in the composite column 27 in FIG. 3 & 4 may be permanently imprinted. The race-number in the spaces or boxes 13 may be permanently imprinted or may be written in by hand. The furlong-numbers in spaces or boxes 14 and the finish-numbers in spaces or boxes 15 and the gallops-needed-to-finish numbers in column 22 (FIGS. 1 & 2) may be imprinted on the play-board or may be written in by hand. The variable numbers in boxes or spaces 13, 14, 15 & 22 may also be changed by mechanical, electro-mechanical, electrical or electronic means, as in the embodiment represented by FIG. 5, in which embodiment the gallops-won numbers in column 23 and the indication of the "win" horse, the "place" horse and the "show" horse in columns 24, 25 & 26 can likewise be displayed by mechanical, electro-mechanical, electrical or electronic means. The win, place and show markings in columns 24, 25 & 26 may be light-emitting means or suitable mechanically and/or electrically activated markers or indicators 29 shown in FIG. 5. The markers 29 with the suffix X in FIG. 5 represent the lights which have been activated or turned on to indicate the "win" horse, the "place" horse and the "show" horse.

Figure 6:
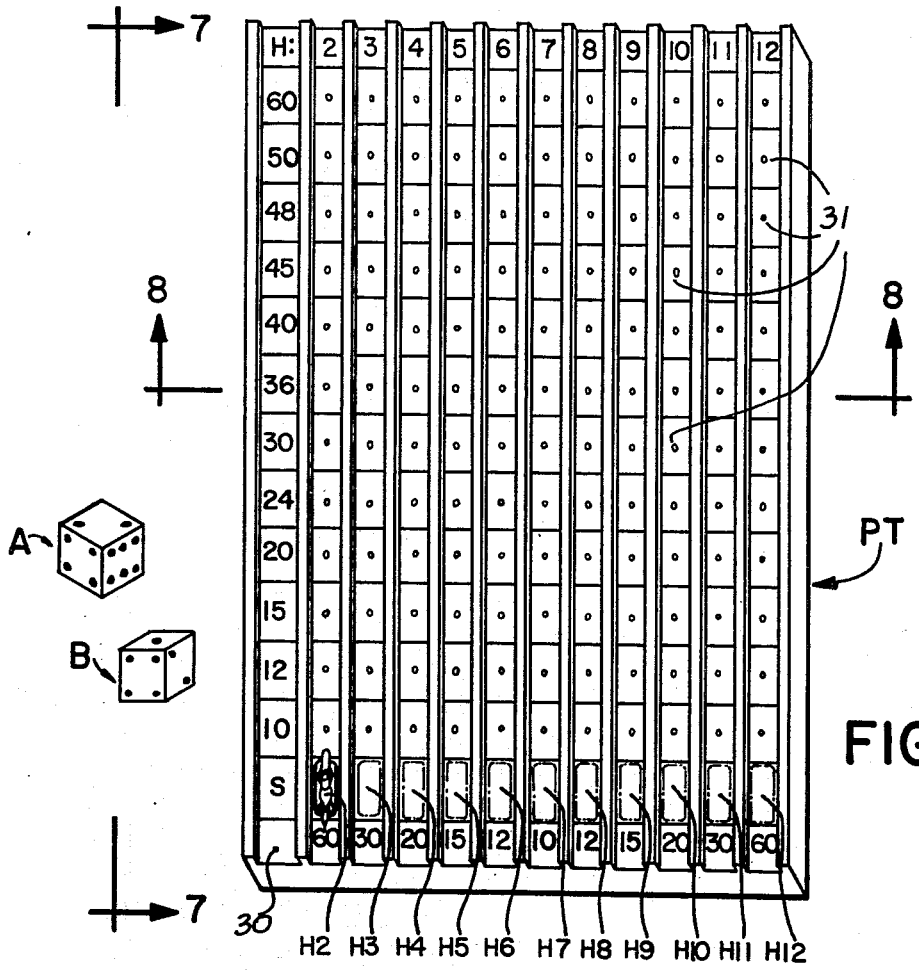
FIG. 6 is a perspective view illustrating another embodiment of my invention, including a play-board on which eleven horse-figurenes numbered 2 to 12, are placed on or in correspondingly numbered tracks 2 to 12, and in which the player advances each horse when its number is thrown by the dice, by moving the horse (whose number has been thrown) towards the "finish" by its gallop-length;- the gallop-lengths being shown in the leftmost column on the play board or panel.
Figure 9:
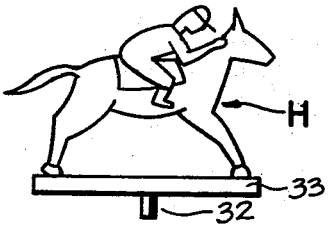
FIG. 9 illustrates one of the eleven numbered horses, for use in conjunction with the play-board shown in FIGS. 6, 7 & 8.
Figure 8:
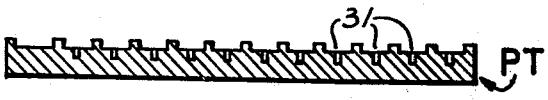
FIG. 8 illustrates a vertical cross-sectional view on lines 8—8 of FIG. 6.
Figure 7:
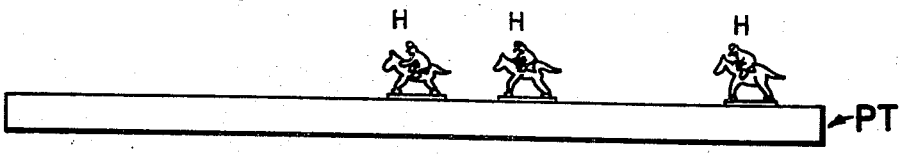
FIG. 7 illustrates a side-elevational view of the monitoring board shown in FIG. 6.

In the embodiment illustrated in FIGS. 6 to 9, the play-panel is designated as PT, to indicate that it is a Play-panel having Tracks. The play-board PT includes eleven tracks, numbered 2 through 12, which are also the horse-numbers. The horses are generally designated by the letter H, and the eleven horses H are generally designated by the letter H, and the eleven horses H are likewise numbered 2 through 12. The Starting position of the horses is designated by the letter S in a channel or on a surface 30 left of the track 2. At the beginning of a race, each of the horses 2 through 12 is placed in the starting position S in its respective track (2 through 12). Below the start position S of each horse, its gallop-length-number is imprinted on the flat surface of the track, below the starting position S, or may be imprinted on the vertical end-surface of the play-board PT in registration with the respective tracks. Beyond the starting horse-spaces S, the one-furlong play-board PT shown in FIG. 6 is divided transversely into twelve equal horse-position spaces, each space about the length of a horse. In a suitable place, in each such horse-position space, a small hole 31 is provided, into which the dowel-pin 32 extending downwardly from the base 33 of the horse H is to be inserted to prevent the horse from being accidentally displaced in either a forward or backward direction.

In the leftmost column 30 of the play-board PT, the successive horse-position progress-spaces along the eleven tracks are marked with all the multiples of the six gallop-length-numbers 10, 12, 15, 20, 30 & 36 within the finish-number of the race.

On the one-furlong play-board PT shown in FIG. 6, such multiples are 10, 12, 15, 20, 24, 30, 36, 40, 45, 48, 50 & 60, and these multiples are marked alongside the twelve horse-position spaces (beyond the starting space S). This permits each horse to be moved to its position representing the number of times its horse-number has been rolled. Thus, with each roll of the dice, the horse whose number has been rolled is advanced in its track by its gallop-length shown at the bottom of the play-board. For example, when horse-number 7 is rolled the first time then horse 7 will be moved into the 10 position shown in the left column (FIG. 6), and if the same horse-number is rolled again at any time during the game, then horse 7 is moved into the 20 position and into the 30, 40, 50 & 60 positions if the race has not come to an end before then. Similarly, if horse-number 5 is rolled the first time then horse 5 is moved into the 15 position, and the second time it is rolled it is moved into the 30 position, and the third time it is rolled it is moved into the 45 position, and the fourth time into the 60 position or winning position (if the race has not ended before then).

My play-board PT can also be provided for a multi-furlong race by lengthening the play-board either in a straight line or in a circle or oval or other configuration, in which the number of horse-position spaces is increased to provide the furlong-number multiples of the numbers shown in column 30 in FIG. 6. Thus, a 2 furlong play-board PT would have 24 successive horse-position spaces, numbered (after the starting position S): 10, 12, 15, 20, 24, 30, 36, 40, 45, 48, 50, 60, 70, 72, 75, 80, 84, 90, 96, 100, 105, 108, 110 & 120. In each case the finish-number is the highest number.

In the embodiments of my invention exemplified in FIGS. 6–9, the holes 31 and dowel-pins 32 may be omitted, and in their place the base 33 of each horse may be a magnetic and the panel PT made of iron or sheet-steel, so that horses can be moved from one position to a higher position without the risk of being accidentally dislodged from the position which they have been placed in accordance with the roll of the dice.

One or more horses may be scratched, and if the dice are thrown to the number of the horse which has been scratched, then such throw of the dice is regarded as a "no action" throw or as a "dead dice". However, at least three horses should remain unscratched so as to provide the "win", "place" and "show" for the race.

When my game is played for bets to be placed on horses, then after the betting has been closed, it is found that no bet has been placed on one or several horses, then the numbers of those horses are scratched by the steward.

Notwithstanding that one or several horses are scratched, the odds on all unscratched horses remain equal.

Notwithstanding that some of the horses are scratched, the finish-number of the race is still 60 for a one-furlong race and a multiple of 60 for any multi-furlong race.

In addition to win, place and show, my game can also be played for perfecto or exacto, daily double, trifecto, etc. and the pay-offs can be made on $2.00 wagers by the exact odds system or pari-mutual betting system (totalisator).

In the casino the use of my game with the pay-offs on the pari-mutual system, the State could collect the same as race tracks pay to the State and the casino operator could collect the same amounts as the tracks.

Where my game is played in a casino, the electrically operated flash-board can be used to show the race, the odds and the pay-offs.

My game is a realistic simulation of a horse-race as run on major tracks.

Having illustrated several embodiments of my invention in the foregoing specification and in the accompanying drawings, I claim the following.

1. A horse-race-simultaing parlour and casino game of pure chance which can optionally be played as a race of any integral number of furlongs, and in which each of eleven horses has mathematically the same chance or probability of coming in first (or to "win") and has mathematically the same chance or probability of coming in second (or to "place") and has mathematically the same chance or probability of coming in third or to "show"), comprising a combination of a pair of dice which can be rolled to eleven numbers, from 2 through 12, and a play-panel having thereon eleven horse-numbers, from 2 through 12, means on the play-panel for indicating a finish-number which is a furlong-number-multiple of the lowest common multiple of the numbers representing the ways in which said eleven horse-numbers can be rolled by the dice, and the play-panel having thereon a chance-equalizing gallop-length-number for each horse which is said lowest-common-multiple divided by the number of ways the horse-number can be rolled by the dice.

2. A horse-race-simulating game according to claim 1, including means for indicating on the play-panel the number of times a horse-number must be rolled until its gallop-length-number multiplied by the number of times it has been rolled equals the finish-number of the race.

3. A horse-race-simulating game according to claim 2, including means for indicating on the play-panel the number of times each horse-number has been rolled as the race progresses.

4. A horse-race-simulating game according to claim 3, including means for indicating on the play-panel the sequence in which the horse-numbers reach the finish-number of the race.

5. A horse-race-simulating game according to claim 1, including means for indicating on the play-panel the number of times each horse-number has been rolled as the race progresses.

6. A horse-race-simulating game according to claim 1, including means for indicating on the play-panel the sequence in which the horse-number reach the finish-number of the race.

7. A horse-race-simulating game according to claim 2, including means for indicating on the play-panel the sequence in which the horse-numbers reach the finish-number of the race.

8. A horse-race-simulating parlour game of pure chance which can optionally be played as a race of any integral number of furlongs, and in which each of eleven horses has mathematically the same chance or probability of coming in first (or to "win") and has mathematically the same chance or probability of coming in second (or to "place") and has mathematically the same chance or probability of coming in third (or to "show"), comprising a combination of a pair of cube-shaped dice and a play-panel, each of the dice having numbers 1 & 6 on one pair of opposite faces and numbers 2 & 5 on another pair of opposite faces and numbers 3 & 4 on the other pair of opposite faces, the play-panel having thereon means for indicating a "finish" number which is a furlong-number-multiple of 60, and having thereon eleven horse-numbers from 2 to 12, and having thereon means for displaying eleven horse-names, in juxtaposition to the horse-numbers and having thereon six chance-equalizing gallop-length-nubers in juxtaposition to the horse-numbers, with the gallop-length-number 60 in juxtaposition to horses 2 & 12, the gallop-length-number 30 in juxtaposition to horses 3 & 11, the gallop-length-number 20 in juxtaposition to horses 4 & 10, the gallop-length-number 15 in juxtaposition to horses 5 & 9, the gallop-length-number 12 in juxtaposition to horses 6 & 8, and the gallop-length number 10 in juxtaposition to horse 7, and having thereon means for indicating the gallops-needed-to-finish numbers in juxtaposition to the horse numbers, with the gallops-needed-number 1 times the number of furlongs in juxtaposition to horses 2 & 12, and the gallops-needed-number 2 times the number of furlongs in juxtaposition to horses 3 & 11, and the gallops-needed-number 3 times the number of furlongs in juxtaposition to horses 4 & 10, and the gallops-needed-number 4 times the number of furlongs in juxtaposition to horses 5 & 9, and the gallops-needed-number 5 times the number of furlongs in juxtaposition to horses 6 & 8, and the gallops-needed-number 6 times the number of furlongs in juxtaposition to horse 7.

9. A horse-race-simulating game according to claim 8, including means on the play-panel for indicating the progress of each horse toward the finish.

10. A horse-race-simulating game according to claim 9, including a provision on the play-panel for indicating the sequence in which the horses finish.

11. A horse-race-simulating game according to claim 8, including a provision on the play-panel for indicating the order in which the horses finish.

12. A horse-race-simulating parlour game of pure chance which can optionally be played as a race of any integral number of furlongs, and in which each of eleven horses has mathematically the same chance or probability of coming in first (or to "win") and has mathematically the same chance or probability of coming in second (or to "place") and has mathematically the same chance or probability of coming in third (or to "show"), comprising a combination of a pair of cube-shaped dice and a play-panel, each of the dice having numbers 1 & 6 on one pair of opposite faces and numbers 2 & 5 on another pair of opposite faces and numbers 3 & 4 on the other pair of opposite faces, the play-panel having means thereon for displaying a finish-number which is a furlong-number-multiple of 60, the play-panel having thereon eleven horse-numbers from 2 to 12, and having thereon means for displaying eleven horse-names in juxtaposition to the horse-numbers, and having thereon gallop-length numbers and means for indicating gallops-needed-to-finish numbers in juxtaposition to the horse-numbers, with the gallop-length-number 60 in juxtaposition to horses 2 & 12, and the gallop-length-number 30 in juxtaposition to horses 3 & 11, and the gallop-length-number 20 in juxtaposition to horses 4 & 10, and the gallop-length-number 15 in juxtaposition to horses 5 & 9, and the gallop-length-number 12 in juxtaposition to horses 6 & 8, and the gallop-length-number 10 in juxtaposition to horse 7.

13. A horse-race-simulating game according to claim 12, including means on the play-panel for indicating the order in which the horses finish.

14. A horse-race-simulating parlour game of pure chance which can optionally be played as a race of any integral number of furlongs and in which each of eleven horses has mathematically the same chance or probability of coming in first (or to "win") and has mathematically the same chance or probability of coming in second (or to "place") and has mathematically the same chance or probability of coming in third (or to "show"), comprising a combination of a pair of cube-shaped dice and a play-panel, each of the dice having numbers 1 & 6 on one pair of opposite faces and numbers 2 & 5 on another pair of opposite faces and numbers 3 & 4 on the other pair of opposite faces, and the play-panel having thereon means for indicating a finish-number which is a furlong-length-multiple of 60 the play-panel having thereon eleven horse-numbers from 2 to 12, and having thereon means for displaying eleven horse-names in juxtaposition to the horse-numbers, and having thereon gallop-length numbers in juxtaposition to the horse-numbers and having thereon means for indicating gallops-needed-to-finish numbers in juxtaposition to the horse-numbers, with the gallop-length-number 60 in juxtaposition to horses 2 & 12, and the gallop-length-number 30 in juxtaposition to horses 3 & 11, and the gallop-length-number 20 in juxtaposition to horses 4 & 10, and the gallop-length-number 15 in juxtaposition to horses 5 & 9, and the gallop-length-number 12 in juxtaposition to horses 6 & 8, and the gallop-length-number 10 in juxtaposition to horse 7;- said gallop-length numbers and said means for indicating the gallop-needed-to-finish numbers providing means for indicating the progress of the horses towards the finish.

15. A horse-race-simulating game according to claim 14, including means on the play-panel for indicating the order in which the horses finish.

16. A horse-race-simulating parlour game of pure chance which can optionally be played as a race of any integral number of furlongs, and in which each of eleven horses has mathematically the same chance or probability of coming in first (or to "win") and has mathematically the same chance or probability of coming in second (or to "place") and has mathematically the same chance or probability of coming in third (or to "show"), comprising a combination of a pair of cube-shaped dice and a play-panel, each of the dice having numbers 1 & 6 on one pair of opposite faces and numbers 2 & 5 on another pair of opposite faces and numbers 3 & 4 on the other pair of opposite faces, and the play-panel having thereon means for indicating a "finish" number which is furlong-number-multiple of 60, and having thereon six horse-numbers from 2 to 7, and having thereon six gallop-length-numbers in juxtaposition to the horse-numbers, with the gallop-length-number 60 in juxtaposition to horse 2, and the gallop-length-number 30 in juxtaposition to horse 3, and the gallop-length-number 20 in juxtaposition to horse 4, and the gallop-length-number 15 in juxtaposition to horse 5, and the gallop-length-number 12 in juxtaposition to horse 6, and the gallop-length-number 10 in juxtaposition to horse 7, and having thereon means for indicating gallops-needed-to-finish numbers in juxtaposition to the horse-numbers, with the gallops-needed-number 1 times the number of furlongs in juxtaposition to horse 2, and the gallops-needed-number 2 times the number of furlongs in juxtaposition to horse 3, and the gallops-needed-number 3 times the number of furlongs in juxtaposition to horse 4, and the gallops-needed-number 4 times the number of furlongs in juxtaposition to horse 5, and the gallops-needed-number 5 times the number of furlongs in juxtaposition to horse 6, and the gallops-needed-number 6 times the number of furlongs in juxtaposition to horse 7.

17. A horse-race-simulating parlour game of pure chance which can optionally be played as a race of any integral number of furlongs, and in which each of eleven horses has mathematically the same chance or probability of coming in first (or to "win") and has mathematically the same chance or probability of coming in second (or to "place") and has mathematically the same chance or probability of coming in third (or to "show"), comprising a combination of a pair of cube-shaped dice and a play-panel, each of the dice having numbers 1 & 6 on one pair of opposite faces and numbers 2 & 5 on another pair of opposite faces and numbers 3 & 4 on the other pair of opposite faces, and the play-panel having thereon means for indicating a finish-number which is a furlong-number-multiple of 60, and having thereon six horse-numbers from 2 to 7, and having thereon gallop-length numbers in juxtaposition to the horse-numbers and having means thereon for indicating gallops-needed-to-finish numbers in juxtaposition to the horse-numbers, with the gallop-length-number 60 in juxtaposition to horse 2, and the gallop-length-number 30 in juxtaposition to horse 3, and the gallop-length-number 20 in juxtaposition to horse 4, and the gallop-length-number 15 in juxtaposition to horse 5, and the gallop-length-number 12 in juxtaposition to horse 6, and the gallop-length-number 10 in juxtaposition to horse 7.

18. A game of pure chance comprising a combination of a pair of dice which can be rolled to eleven numbers, from 2 through 12, and a play-board having thereon eleven play-numbers, from 2 through 12, and having thereon means for indicating a finish-number which is an integral-number-multiple of the lowest common multiple of the numbers representing the ways in which said eleven play-numbers can be rolled by the dice, and having thereon a chance-equalizing number for each play-number which chance-equalizing-number is said lowest-common-multiple divided by the number of ways the play-number can be rolled by the dice.

19. A game of pure chance according to claim 18, including means for indicating on the play-board the number of times a play-number must be rolled by the dice until its chance-equalizing number multiplied by the number of times it has been rolled equals the finish-number of the game.

20. A game of pure chance according to claim 19, including means for indicating on the play board the number of times each play-number has been rolled as the game progresses.

21. A game of pure chance according to claim 18, including means for indicating on the play board the number of times each play-number has been rolled as the game progresses.

* * * * *